US008590478B2

(12) United States Patent
Lipman

(10) Patent No.: US 8,590,478 B2
(45) Date of Patent: Nov. 26, 2013

(54) CONVERTIBLE PADDLED WATERCRAFT

(75) Inventor: James Warren Lipman, Anacortes, WA (US)

(73) Assignee: Cruiserboard Company, LLC, San Diego, CA (US)

( * ) Notice: Subject to any disclaimer, the term of this patent is extended or adjusted under 35 U.S.C. 154(b) by 253 days.

(21) Appl. No.: 13/071,230

(22) Filed: Mar. 24, 2011

(65) Prior Publication Data

US 2012/0077396 A1 Mar. 29, 2012

Related U.S. Application Data

(60) Provisional application No. 61/317,146, filed on Mar. 24, 2010.

(51) Int. Cl.
*B63B 17/00* (2006.01)

(52) U.S. Cl.
USPC ..... 114/363; 114/347

(58) Field of Classification Search
USPC ..... 114/343, 345, 347, 363
See application file for complete search history.

(56) References Cited

U.S. PATENT DOCUMENTS 5,619,949 A * 4/1997 Dick, Jr. ..... 114/363
7,789,035 B1 * 9/2010 Rosenberg et al. ..... 114/363

* cited by examiner

*Primary Examiner* — Lars A Olson
(74) *Attorney, Agent, or Firm* — Richard A. Clegg

(57) ABSTRACT

A paddled watercraft is disclosed that is readily convertible between a stand-up paddleboard configuration and a seated paddling configuration. The watercraft includes a board with an operator body support assembly attached onto the top deck of the board, the body support assembly being capable of being reconfigured to support a person in a standing position for padding from a standing position, or to support a person in a seated position for paddling from a seated position. The watercraft can be converted from stand-up paddling configuration to a seated paddling configuration while underway on open waters.

5 Claims, 5 Drawing Sheets

CONVERTIBLE PADDLED WATERCRAFT

CROSS-REFERENCE TO RELATED APPLICATIONS

This applications claims priority based on Provisional Application No. 61/317,146, filed Mar. 24, 2010.

BACKGROUND OF THE INVENTION

1. Field of the Invention

The present invention relates generally to the field of paddled recreational watercraft, such as canoes, paddleboards and kayaks.

More particularly, the invention relates to a paddleboard watercraft that is readily convertible, while on the open water, between a stand-up paddleboard ("SUP") mode, in which the user paddles the watercraft from a standing position, and a sit-on-top watercraft ("SOW") mode, in which the user sits on a pivoting chair assembly and paddles the watercraft from a seated position 2. Description of Related Art In recent years, a variety of different types of recreational paddleboats have been developed and have become popular.

The use of stand-up paddleboards (referred to below as an "SUP" or "SUPs") has become popular. An SUP can be a large surfboard, or a specially made board that is usually shaped much like a surfboard. The person stands on top of the SUP and uses a long, single-bladed paddle to propel the craft forward. SUPs can be used on rivers, lakes or on the ocean, and are well suited to surfing on waves. An SUP provides an entertaining and efficient way for a person to move across the surface of a body of water or to surf on waves. It is also an excellent form of exercise.

The use of "sit-on-top" kayaks has also become increasing popular. A "sit-on-top" kayak is different than a traditional kayak, in which the person's legs and lower body must be lowered into the kayak through an opening in the top deck. A sit-on-top kayak does not have any opening through which a person can insert their legs and lower body into the boat. Instead, the person sits on the top deck of the boat, with their legs sticking forward toward the bow. The top deck of the boat is typically shaped to conform to the contours of the person's legs and lower body. Getting onto the boat is much easier than getting into a traditional kayak. Also, if the boat flips, the person is not trapped inside the boat, but will simply fall off the boat as it flips, much like falling off a surfboard.

Sit-on-top kayaks have become particularly popular with fishermen, in particular. They provide simple, maneuverable access to most fishing waters, and they also provide an excellent platform for fishing. Sit-on-top kayaks often include rod-holders, tackle holders, and other accessories for fishing.

Notwithstanding the recent popularity of stand-up paddle boarding and sit-on-top kayaking, there has been an absence of watercraft designs that provide the features and benefits of both types of watercraft in a single, convertible watercraft structure.

A standup paddleboard (SUP) called the Bote Board, manufactured by Boat Boards of Destin, Fla., U.S.A., includes a removable leaning post that is inserted into holes formed in the top surface of the paddleboard. The removable leaning post sticks up from the top surface of the paddleboard. A person can lean back against the leaning post while paddling the board from a standing position. The leaning post is equipped with a paddle clip, rod holders and hooks for hanging items such as a backpack. However, the support is not convertible to a seated paddling mode. A person could sit on some object (such as a small ice cooler) positioned near the leaning post but the object (e.g., the ice cooler) would the space where the person would need to stand if they decided to switch from a sitting position to a standing position, to paddle the boat from a standing position. Thus, to switch from a seated position to a standing position, the person would need to remove the cooler. In addition to the support post not incorporating any seating structure, the rake (the forward or rearward tilt of the support structure) is fixed in place and cannot be adjusted.

In view of the above, there is a need for a recreational watercraft that provides many of the important features and benefits of both SUPs and SOWs, in a single watercraft structure that is readily convertible between SUP and SOW modes.

BRIEF SUMMARY OF THE INVENTION

The present invention provides a watercraft that is readily convertible between a stand-up paddleboard (SUP) mode, and a sit-on-top watercraft ("SOW") mode. The term SOW would include a sit-on-top kayak, but is not limited to a kayak. The he present invention is directed to a watercraft that is based as much on a paddleboard design as a kayak design.

The watercraft includes a rigid body support assembly that can be converted from a stand-up paddling configuration to a seated paddling configuration. The conversion can be done while the boat is being used on the open water, by pivoting the seat surface to a vertical position within the body support structure (the SBU configuration). The watercraft can also be converted to a traditional surfboard form, a third mode, by pivoting the entire support structure downward to lie flat on the watercraft's horizontal deck surface.

In a basic aspect, the invention is generally directed to a paddle driven watercraft that is convertible between a stand-up paddleboard configuration and a seated paddling configuration. The watercraft comprises: a) a board portion having a generally horizontal upper deck surface, a starboard side, a port side, a fore end, an aft end and a longitudinal axis extending between the fore end and the aft end; and b) a convertible operator support assembly, which is fastened to the board's upper deck surface. The operator support assembly comprises a first vertical support post with a first end portion that is connected to the board portion, with the post extending generally upward from the board. A seat structure is pivotally connected to the first vertical support post, such that the seat can be pivoted downward to a horizontal seating position or upward to a vertical seat storage position.

In one embodiment, the operator support assembly comprises a first vertical support post having a first end that is connected to the board portion with the first support post extending vertically upward from the board, between the longitudinal axis and the starboard side of the board portion, and a second vertical support post having a first end that is connected to the board portion with the second support post extending vertically upward from the board, between the longitudinal axis and the port side of the board portion, and a cross-support that extends horizontally between the first and second support posts, above the deck of the board portion. A flat seat structure is pivotally connected to the first and second vertical support posts, between the two support posts, such that it can be pivoted to a horizontal seating position or to a vertical seat storage position between the first and second support posts and below the cross support.

In another embodiment, the operator support assembly includes one or more base members that are attached to the surface of the board. The base members are used to connect the support structure to the board, to provide mechanical support for the operator support assembly, and to distribute the forces that are exerted against the board by the support structure (including those forces caused by a person leaning against or sitting upon the support structure) over a broader area. The base members can have a variety of different shapes so long as they provide an appropriate way for connection to the board's deck, and provided they are capable of handling the forces generated by the weight of the operator support assembly and any person resting against the operator support assembly (in a standing or seating position).

In one preferred embodiment, the base members comprise first and second elongated rails or tracks, oriented generally parallel to the board's longitudinal axis. The first and second rails provide a connection point for the first and second support posts, respectively. The base members may be made of any suitably rigid material, including aluminum or ABS plastic. In a particularly preferred embodiment, the first and second rails are hollow tubes (preferably square in cross section) made of ABS plastic, with longitudinal slots on the top of tube, running the length of the tube. The ends of the tubes are adapted to receive a flange with an enlarged portion that slides within the tube, a narrow portion that extends out through the slot, and a mounting plate portion outside the tube, to which the rest of the operator support assembly is attached. With this arrangement, the entire support structure can be shifted forward or aft on the board, to adjust the specific location of the support structure relative to the watercraft's bow and stern. The support structure assembly can then be fixed in place at a desired position, using a screw, bolt, pin, shackle, clamp or the like.

In another embodiment, the operator support assembly (or the portion above the base members that are attached to the deck of the board) can be tilted forward or backward relative to the deck, and locked into different positions with different degrees of positive (forward) or negative (backward) rake.

DETAILED DESCRIPTION OF THE INVENTION

Figure 1:
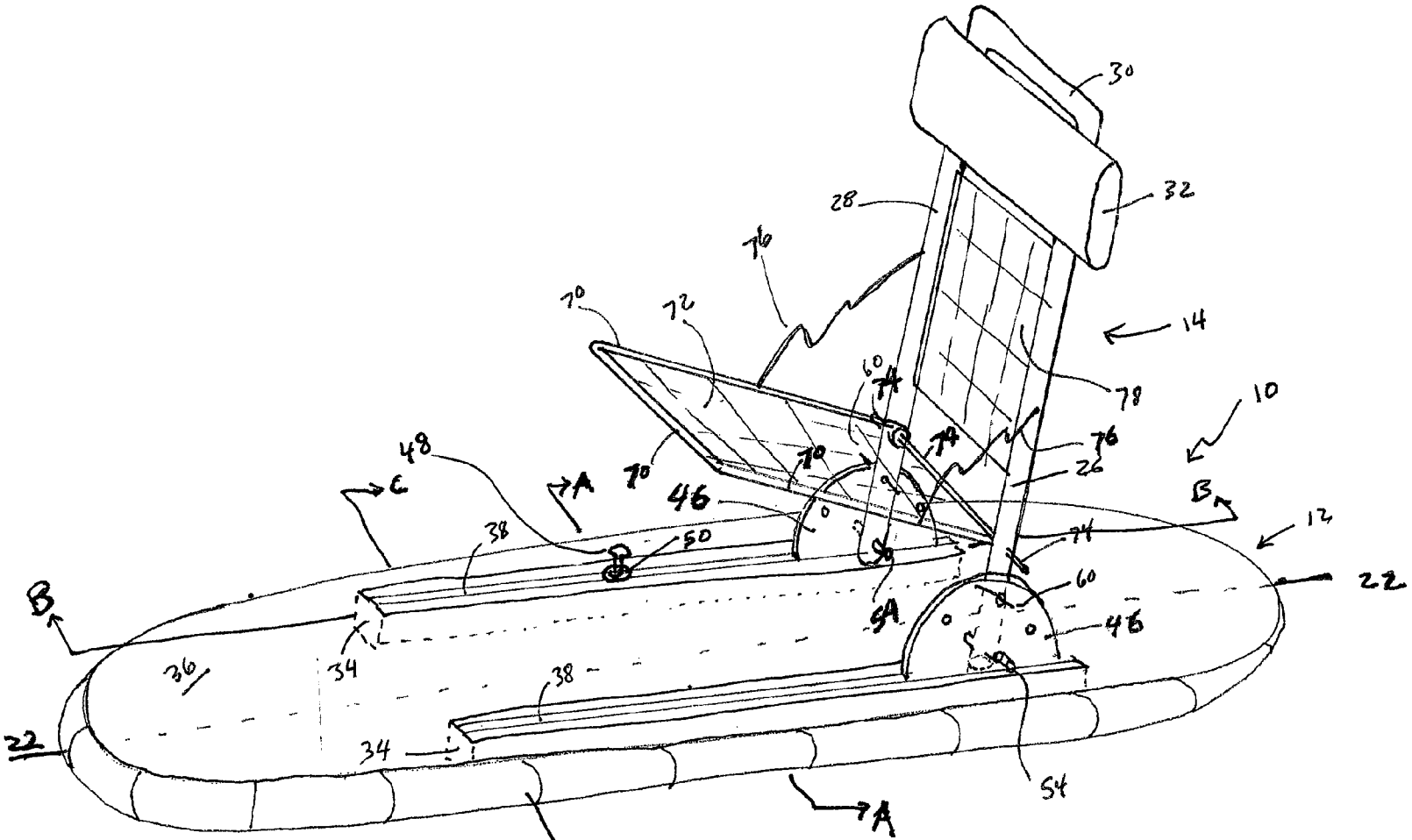
FIG. 1 of the drawing shows a perspective view of one embodiment of a convertible watercraft made according to the present invention.

FIGS. 1-5 show the details of exemplary embodiments of a watercraft made in accordance with the present invention. As shown in FIG. 1, the watercraft 10 comprises a board 12 and an operator body support assembly 14 that is mounted onto the board 12.

Figure 5:
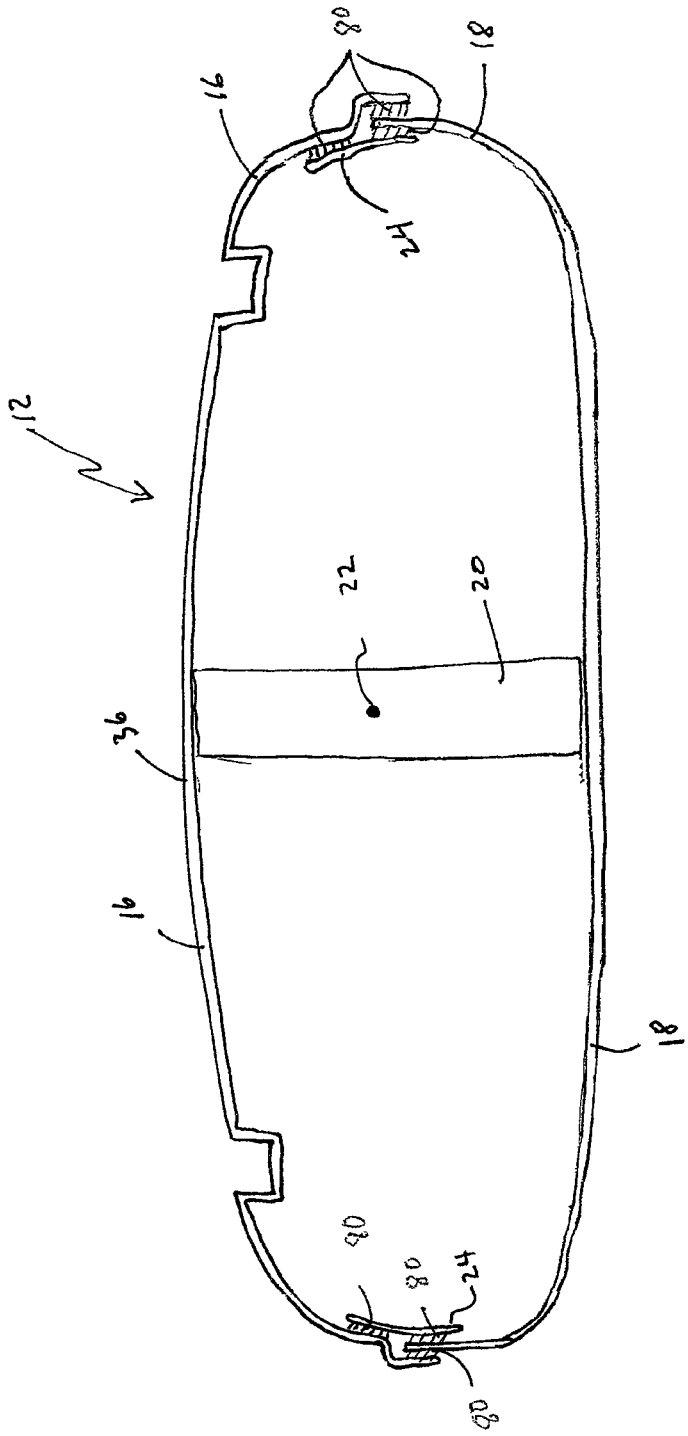
FIG. 5 of the drawing shows a cross-sectional view of the hull of a watercraft in accordance with the present invention, taken along C-C of FIG. 1.

The board 12 an be constructed in any way that is suitable for making surfboards or small recreational watercraft, including with fiberglass on foam, molded shells, or any of a variety of different polymeric materials or other materials. Preferably, the board 12 is made of molded ABS plastic, with a molded top shell 16 and a molded bottom shell 18 being joined together along their edges to form a hollow board 12, as shown in FIG. 5. The top and bottom shells 16 and 18 preferably have a substantially uniform wall thickness of about ¼ inches and ⅜ inches.

As shown in FIG. 5, the hollow interior of the board 12 includes a generally rigid stringer 20, in the form of an elongated plank, rectangular in cross-section, made of closed cell foam. The stringer 20 preferably extends from the bow to the stern inside the hollow hull, parallel to the board's longitudinal axis 22, to lend rigidity to the hull when a person is standing on the board. The stringer 20 has a sufficient height to extend fully between the inner surfaces of the top shell and the bottom shell, extending along the longitudinal axis 22 of the board 12. The board 12 may also include one or more internal ribs or spars or other structures to provide structural support.

The joints between the top and bottom shells 16 and 18 are preferably formed with the edge of the bottom shell 18 being sandwiched between the lower the wall of the upper shell 16 and a tab 24 that runs along the edge of the wall of the upper shell 16, at a point where the wall of the upper shell juts outward and then downward, as shown in FIG. 5, to form a thin slot or channel into which the wall of the lower shell 18 can be positioned. The attachments between the upper and lower walls and between the upper wall and the tab can be made in any of a variety of suitable ways. Preferably, they are glued together using an adhesive 80. The adhesive can be any type of adhesive that will form strong bonds between the components to be joined.

Figure 2:
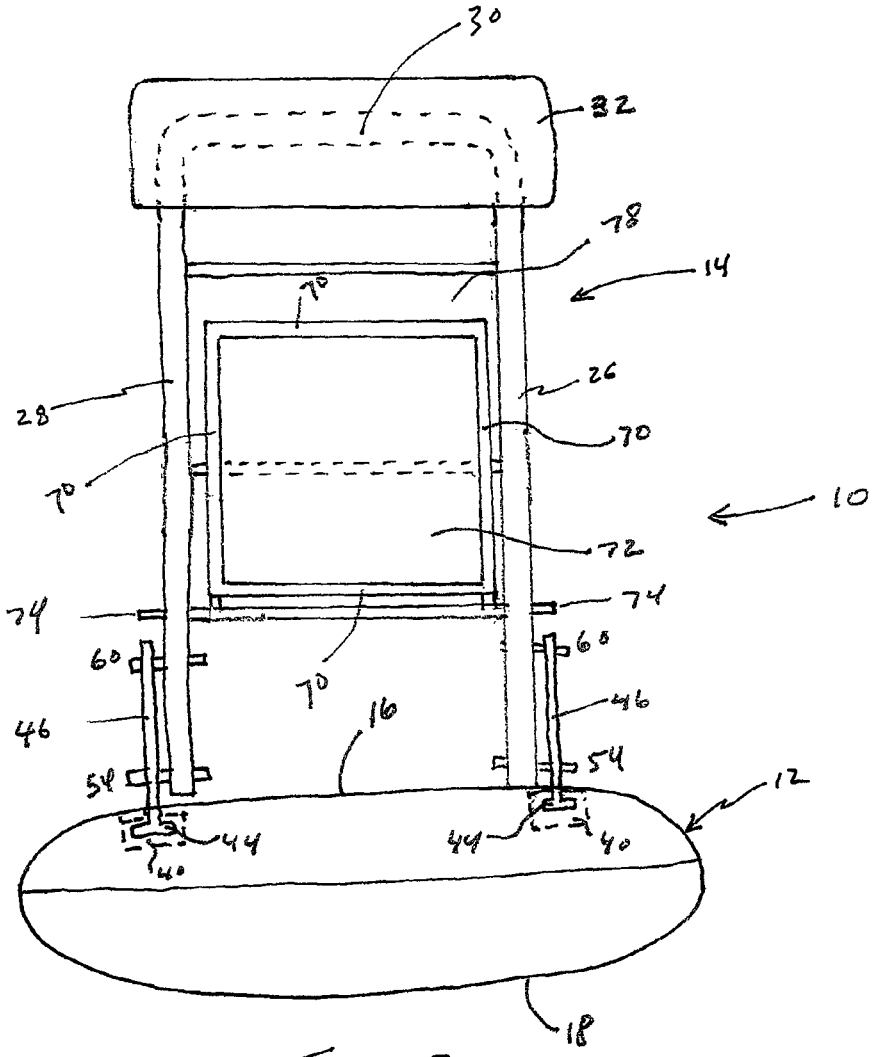
FIG. 2 of the drawing shows a front view of the convertible watercraft of FIG. 1.

As shown in FIG. 1 and FIG. 2, the operator support 14 generally comprises a first support post 26, a second support post 28 and a cross member 30. The cross member 30 can, and preferably does, have a cushion or pad 32 attached to the cross member 30, against which a person can lean when paddling the watercraft from a standing position.

The posts and cross member 26, 28 and 30 can be made of any suitable rigid pipe or tubing, including aluminum tubing, PVC pipe, roto-molded polyethylene pipe, stainless steel pipe or the like. Preferably, they are made using 5052 or 5086 aluminum pipe, with an outer diameter of ⅞ inches and a wall thickness of between ⅛ and 3/16 inches, and with an anodized or powder coated surface. The posts and cross member can be separate structures that are joined together with appropriate fittings, connectors or welds. Preferably, however, they are formed from a single piece of tube or pipe (such as aluminum alloy pipe) that is bent or formed to shape.

The lower ends of the posts 26 and 28 can be fixed to the board 12 in any of a variety of different ways. Preferably, the operator body support assembly 14 includes at least one horizontally oriented base member 34, which is attached to the upper deck surface 36 of the board 12. The base member(s) 34 distribute the forces from the operator support 14 onto the board 12, over a larger area than if the posts were connected directly to the board at a single point or held in place by inserting the posts 26 and 28 into bores drilled into the top surface of the board. The base member(s) 34 can be as simple as a single horizontal plate of rigid material that can be fastened to the upper deck surface 36 of the board 12, with the support structure 14 being attached to the deck via the base member 34. The base member(s) 34 can have any of a variety of different shapes that allow the base member to be mounted onto the board 12 and provide adequate structural support for the operator body support 34 when the watercraft is being used in either the SUP or the SOW mode.

Figure 3:
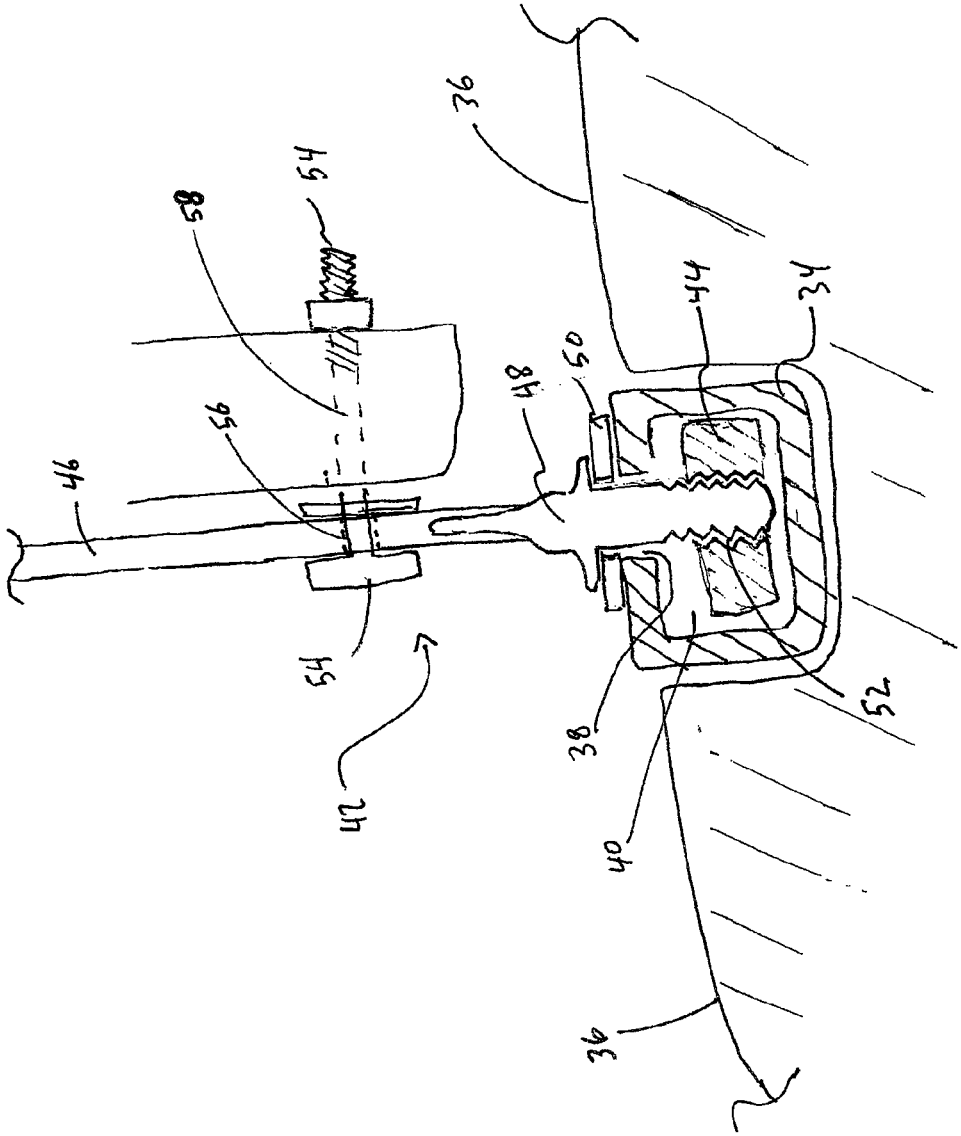
FIG. 3 of the drawing shows a cross-sectional view of a track assembly and a hinge plate that slides along the track assembly, taken along A-A of FIG. 1.
Figure 4:
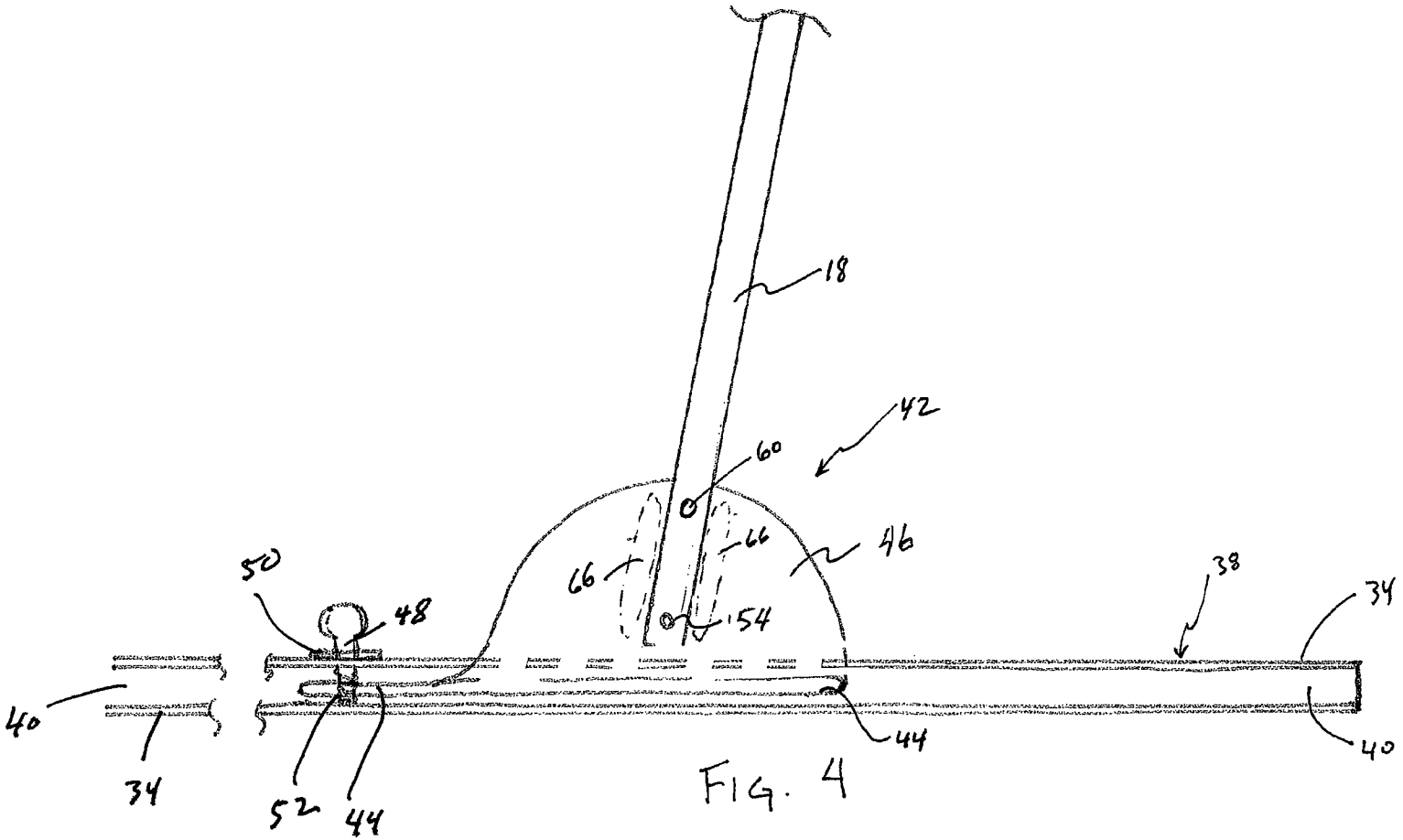
FIG. 4 of the drawing FIG. 3 of the drawing shows a cross-sectional view of a track assembly and a hinge plate that slides along the track assembly, taken along B-B of FIG. 1.

In the embodiments shown in FIG. 1 and FIG. 2, and as shown in more detail in FIGS. 3 and 4, there are two base members 34, each in the form of an elongated, linear track comprising a straight, rigid hollow square tube with a slot 38 in its upper surface, which extends into the hollow interior 40 of base member/track 34. The base members can be attached to the upper deck surface of the board 12 using a suitable adhesive, rivets, bolts or any similar attachment means.

As shown in FIG. 3 and FIG. 4, a hinge plate connector assembly 42 includes an expanded portion 44 that is positioned inside the hollow space 40 of the member. A hinge plate 46 extends vertically upward from the portion 40 through the slot 38, aligned with the slot 38. The expanded portion 44 is wider than the slot 38, so the expanded portion 44 is trapped inside the hollow interior 40 of the member/track 34, but is capable of sliding within the member/track 34. This arrangement allows each connector assembly 42, including the hinge plate 46, to slide forward or aft in the slot 38 of the base member 34, to adjust the position of the operator body support 14 on the upper deck 36 of the watercraft. The hinge plate connector assembly 42 can be locked in place at a desired location on the member 34, using any of a variety of clamps, screws, fasteners or other suitable structures.

As shown in FIG. 3 and FIG. 4, the hinge plate connector assembly 42 can be locked in place at a desired location on the member/track 34 using a screw 48 that is inserted through a washer 50, through the slot 38 and into a threaded bore 52 formed in the top surface of the expanded portion 44 located inside the hollow space 40 inside the member/track 34. The head of the screw is too wide to pass through the washer or the slot, so tightening the screw into the threaded bore 52 causes the expanded portion 44 to rise and press against the inner surface of the member 34, thereby locking the connector assembly 42 and the hinge plate 46 in place on the member 34. The screw preferably includes a knob or flat head at its top end, so a user can actuate the screw manually and without needing any tools.

The bottom end of each support post 26 and 28 is pivotally attached to the hinge plate 46 that extends upward through the slot 38. The hinge plate connector assembly 42, including the hinge plate 46, is preferably made of rigid ABS plastic, but they can also be made using other any other material, such as aluminum or stainless steel, that is suitably rigid and shapeable.

The hinge plate 46 may have any of a variety of different shapes, including rectangular or curved. The hinge plate 46 is preferably semicircular, with a large enough radius to provide a size and strength sufficient to sustain the forces that are exerted against the hinge plate 46 in use. Preferably, when made using ABS plastic, the hinge plate 36 has a radius of between about 8 inches and 12 inches and a thickness of about ¾ inches. The lower ends of the first and second support posts 26 and 28 are pivotally connected (directly or indirectly) to the hinge plate 46, with a pin 54 that extends though a bore 56 in the hinge plate 46 and a corresponding bore 58 in the support post 26 or 28.

The rake (tilt) of the support posts 26 and 28, and of the entire operator body support assembly 14, can be adjusted by pivoting the support posts about the pin 54. When the support posts have been pivoted to achieve the desired rake for the support assembly, the position of the support posts can be fixed in place by extending a removable pin 60 though a second bore 62 in the post 26 or 28 and through a corresponding second bore 64 in the hinge plate 36. The post can also be held in place by forming a detent between two raise areas 66 on the surface of the hinge plate 46, with the seat post being held in place in the detent that is formed between the two raised areas 66.

The seat assembly 68 can have any suitable shape or construction that will provide an appropriate seating surface. Preferably, the seat assembly 68 comprises a rectangular, planar frame 70 with a flexible plastic mesh or other suitable material attached to the rectangular frame to form a seating surface 72. The seat assembly 68 is positioned between the first and second support posts 26 and 28, and pivots on an axle 74 that extends between the first and second support posts 26 and 28 and through a bore in each support post. A support tether 76 extends from each support post 26 or 28 to the correspondence lateral edge of the seat frame 70, to support the seat frame 70 and the seating surface 72 in a generally horizontal orientation for sitting. The leading edge of the seat frame 70 can be pivoted upward between the first and second posts for storage, to enable the watercraft 10 to be used in the SUP mode.

A vertically oriented back support 78 can also be hung between the first and second posts 26 and 28. The back support 78 can be made from any suitable material, and is preferably made of the same mesh material as the seating surface 48.

The ability to pivot the seat from a horizontal "seating" position to a vertical "standing" position, allows a user to switch between a SUP mode and a SOW mode while underway on open water.

What is claimed is:

1. A watercraft that is convertible between a stand-up paddleboard configuration and a seated paddling configuration, the watercraft comprising: a) a board portion having a substantially flat upper deck surface, a starboard side, a port side, a fore end, an aft end and a longitudinal axis extending between the fore end and the aft end; and b) an operator body support assembly, that is fixed onto the upper deck surface of the board portion, said operator support assembly comprising: (i) a first vertical support post having a first end that is connected to the board portion with the rest of the support post extending generally vertically upward from the board; and (ii) a seat structure that is pivotally connected to the first vertical support post such that it can be pivoted to a horizontal seating position or to a vertical seat storage position, wherein the operator body support assembly is pivotally connected to the board and can be tilted forward or backward to a desired position.

2. A watercraft that is convertible between a stand-up paddleboard configuration and a seated paddling configuration, the watercraft comprising (a) a board portion having a substantially flat upper deck surface, a starboard side, a port side, a fore end, an aft end and a longitudinal axis extending between the fore end and the aft end; and (b) an operator body support assembly that is fixed onto the upper deck surface of the board portion, said operator support assembly comprising a first vertical support post having a first end that is connected to the board portion with the first support post extending vertically upward from the board between the longitudinal axis and the starboard side of the board portion, and a second vertical support post having a first end that is connected to the board portion with the second support post extending vertically upward from the board between the longitudinal axis and the port side of the board portion, and a cross-support that extends horizontally between the first and second support posts, above the deck of the board portion; and a seat structure that is pivotally connected to the first and second vertical support posts, such that it can be pivoted between a horizontal seating position and a vertical seat storage position with the seat stored between the first and second supports, and wherein the operator body support structure comprises first and second horizontally oriented base members that are attached onto the board's substantially flat upper deck surface, with the first end of the first support post being connected to the first horizontally oriented base member and the second support post being connected to the second horizontally oriented base member, and wherein each of the first and second base members comprises a hollow, straight, rigid tube attached to the upper deck of the board, the tube having an upper surface and a slot that extends the length of the upper surface and into the hollow interior of the tube.

3. The watercraft of claim 2, wherein the hollow, straight, rigid tube is rectangular in cross section.

4. The watercraft of claim 3, further comprising a hinge plate connector assembly with an expanded portion that is wider than the slot and positioned inside the tube, the hinge plate connector assembly further comprising a hinge plate that extends vertically upward through the slot from the expanded portion, the hinge plate connector assembly being slideable along the tube to adjust the position of the hinge plate connector relative to the board.

5. The watercraft of claim 4, wherein at least one of the hinge plate connector assemblies comprises means for locking the hinge plate connector assembly in place at a desired location on the associated base member.

* * * * *